US009340404B2

(12) United States Patent
Orita

(10) Patent No.: US 9,340,404 B2
(45) Date of Patent: May 17, 2016

(54) WATER SERVER

(75) Inventor: Yoshinori Orita, Kakogawa (JP)

(73) Assignee: Kabushiki Kaisha Cosmo Life, Hyogo (JP)

( * ) Notice: Subject to any disclaimer, the term of this patent is extended or adjusted under 35 U.S.C. 154(b) by 0 days.

(21) Appl. No.: 14/381,301

(22) PCT Filed: Jul. 6, 2012

(86) PCT No.: PCT/JP2012/067323

§ 371 (c)(1),
(2), (4) Date: Sep. 29, 2014

(87) PCT Pub. No.: WO2013/128667

PCT Pub. Date: Sep. 6, 2013

(65) Prior Publication Data

US 2015/0041005 A1 Feb. 12, 2015

(30) Foreign Application Priority Data

Mar. 2, 2012 (JP) ..... 2012-046513

(51) Int. Cl.
*B67D 3/00* (2006.01)
*B67D 1/00* (2006.01)
(Continued)

(52) U.S. Cl.
CPC ..... *B67D 3/0003* (2013.01); *B67D 1/0004* (2013.01); *B67D 1/0006* (2013.01);
(Continued)

(58) Field of Classification Search
CPC ..... B67D 1/12; B67D 3/0003; B67D 1/0888; B67D 1/1243; B67D 1/0431; B67D 1/0871; B67D 1/0006; B67D 1/0004; B67D 2001/1263; Y10T 137/85986
USPC ..... 222/146.1, 63, 67, 64; 137/565.11
See application file for complete search history.

(56) References Cited

U.S. PATENT DOCUMENTS 6,056,154 A * 5/2000 Fowler ..... 222/1
6,732,885 B2 * 5/2004 Mathues ..... 222/1
(Continued)

FOREIGN PATENT DOCUMENTS

JP 08-066681 3/1996
JP 2000-229699 8/2000
(Continued)

OTHER PUBLICATIONS

International Search Report issued Jul. 31, 2012 in International (PCT) Application No. PCT/JP2012/067323.
(Continued)

*Primary Examiner* — Kevin P Shaver
*Assistant Examiner* — Robert Nichols, II
(74) *Attorney, Agent, or Firm* — Wenderoth, Lind & Ponack, L.L.P.

(57) ABSTRACT

A water dispenser includes a pump which can lift water in an exchangeable raw water container into a water storage tank in a casing. The water dispenser further includes a water level sensor in the form of a float sensor for detecting the upper limit and the lower limit of the water level in the water storage tank. The water dispenser further includes a controller adapted to activate the pump upon receiving a sensor input indicative of detection of the lower limit, and deactivate the pump upon receiving sensor input indicative of detection of the upper limit. The controller is further adapted to measure the time elapsed since the pump was activated, and deactivate the pump when the time elapsed reaches a predetermined time at which the water level exceeds the upper limit and at which water in the water storage tank has not yet overflown the water storage tank.

2 Claims, 4 Drawing Sheets

(51) Int. Cl.

| | |
|---|---|
| ***B67D 1/08*** | (2006.01) |
| ***B67D 1/12*** | (2006.01) |
| ***B67D 1/04*** | (2006.01) |

(52) U.S. Cl.

CPC ..... *B67D1/0431* (2013.01); *B67D 1/0857* (2013.01); *B67D 1/0871* (2013.01); *B67D 1/0888* (2013.01); *B67D 1/0895* (2013.01); *B67D 1/0897* (2013.01); *B67D 1/12* (2013.01); *B67D 1/1243* (2013.01); *B67D 2001/0814* (2013.01); *B67D 2001/1263* (2013.01); *B67D 2210/00023* (2013.01); *Y10T 137/85986* (2015.04)

(56) References Cited

U.S. PATENT DOCUMENTS

| | | | | |
|---|---|---|---|---|
| 6,793,099 | B1 * | 9/2004 | Sleiman | 222/67 |
| 6,868,986 | B1 * | 3/2005 | Arnold | 222/66 |
| 7,597,215 | B2 * | 10/2009 | Sleiman | 222/65 |
| 2010/0252570 | A1 | 10/2010 | Yui | |
| 2011/0259913 | A1 | 10/2011 | Yui et al. | |

FOREIGN PATENT DOCUMENTS

| | | |
|---|---|---|
| JP | 2001-153523 | 6/2001 |
| JP | 2005-022690 | 1/2005 |
| JP | 4802299 | 10/2011 |

OTHER PUBLICATIONS

Written Opinion of the International Searching Authority issued Jul. 31, 2012 in International (PCT) Application No. PCT/JP2012/067323 (with English translation).

Extended European Search Report issued Oct. 9, 2015 in European Patent Application No. 12869765.3.

* cited by examiner

Flowchart of controlling a pump with a controller

Functional block diagram of controller

WATER SERVER

TECHNICAL FIELD

This invention relates to a water dispenser including a water storage tank into which water in an exchangeable raw water container is transferred such that water in the water storage tank can be discharged as drinking water.

BACKGROUND ART

Such water dispensers are configured such that when a user opens a valve by operating a lever or a cock, water in the water storage tank is discharged through a water discharge line and can be poured into e.g. a user's cup. One of such water dispensers has a raw water container located at the lower portion of the casing with the water storage tank located at a level higher than the raw water container. With this arrangement, when exchanging the raw water container with a new one, it is not necessary for an operator to lift the heavy brand-new raw water container to a high level, thus saving the labor of the operator. Since the water storage tank is provided at a higher level than the raw water container, it is necessary to lift water in the raw water container into the water storage tank through a water supply line by means of a pump (see the below-identified Patent documents 1 and 2).

PRIOR ART DOCUMENTS

Patent Documents

Patent document 1: JP Patent Publication 2001-153523A (see especially FIG. 1 and paragraph [0012])
Patent document 2: JP Patent 4802299

SUMMARY OF THE INVENTION

Object of the Invention

During operation of such a water dispenser, the water level in the water storage tank is being monitored by a water level sensor. The water dispenser includes a controller configured to activate the pump upon receiving a sensor input indicative of detection of the lower limit of the water level, and to deactivate the pump upon receiving a sensor input indicative of detection of the upper limit of the water level. The upper limit of the water level is set at a value at which water never overflows from the water storage tank. However, if the water level sensor becomes unable to accurately detect the upper limit of the water level, water could overflow the tank.

An object of the present invention is to prevent overflow of the water storage tank even if the water level sensor becomes unable to accurately detect the upper limit of the water level.

Means for Achieving the Object

In order to achieve this object, the present invention provides a water dispenser comprising a water supply line through which water in an exchangeable raw water container is drawn up to a water storage tank provided in a casing by means of a pump, a water discharge line through which water in the water storage tank is discharged, and a water level sensor configured to detect the upper limit of the water level in the water storage tank and the lower limit of the water level, and a controller for controlling the pump, wherein the controller is configured to activate the pump upon receiving a sensor input indicative of detection of the lower limit, and to deactivate the pump upon receiving a sensor input indicative of detection of the upper limit, and wherein the controller is further configured to measure the time elapsed since the pump was activated, and deactivate the pump when the time elapsed reaches a predetermined time at which the water level exceeds the upper limit and at which water in the water storage tank has not yet overflown the water storage tank.

The pump lifting capacity of the pump determines the time periods after the controller activates the pump upon receiving a sensor input indicative of the lower limit of the water level until the water level reaches the upper limit and until water overflows the water storage tank. Both these time periods can be measured by experiments. If the pump is still operating after the time has passed when the water level is supposed to have reached the upper limit, this means that water could overflow the tank. With the arrangement of the present invention, in which the controller measure the time elapsed since the pump was activated, and deactivates the pump when the time elapsed reaches a predetermined time at which the water level exceeds the upper limit and at which water in the water storage tank has not yet overflown the water storage tank, it is possible to prevent overflow of the water storage tank even if the water level sensor becomes unable to accurately detect the upper limit of the water level.

A float sensor may be used as the water level sensor. The float sensor includes a lower limit detecting switch and an upper limit detecting switch which are configured to be opened and closed according to the vertical position of a float which moves up and down while being guided by a guide (such as a stem or a pivot arm) mounted to the tank, as the water level rises and falls. There could be a time when various factors cooperate to temporarily make it difficult for the float to smoothly move up and down, or completely stop its movement, thereby making it impossible for the water level sensor to normally detect the upper limit of the water level. However, the conditions that have prevented smooth movement of float could disappear later, allowing the float sensor to spontaneously return to normal. Thus it will not be advantageous for a user to lock the pump in its inoperative state as soon as the sensor becomes unable to detect the upper limit. Thus, if the sensor becomes unable to detect the upper limit of the water level, the input data from the water level sensor should be simply reset, instead of locking the pump.

Advantages of the Invention

As described above, since the water dispenser according to the present invention comprises a water supply line through which water in an exchangeable raw water container is drawn up to a water storage tank provided in a casing by means of a pump, a water discharge line through which water in the water storage tank is discharged, and a water level sensor configured to detect the upper limit of the water level in the water storage tank and the lower limit of the water level, and a controller for controlling the pump, wherein the controller is configured to activate the pump upon receiving a sensor input indicative of detection of the lower limit, and to deactivate the pump upon receiving a sensor input indicative of detection of the upper limit, and wherein the controller is further configured to measure the time elapsed since the pump was activated, and deactivate the pump when the time elapsed reaches a predetermined time at which the water level exceeds the upper limit and at which water in the water storage tank has not yet overflown the water storage tank, it is possible to prevent overflow of the water storage tank even if the water level sensor becomes unable to normally detect the upper limit of the water level.

DETAILED DESCRIPTION OF THE INVENTION

Figure 2:
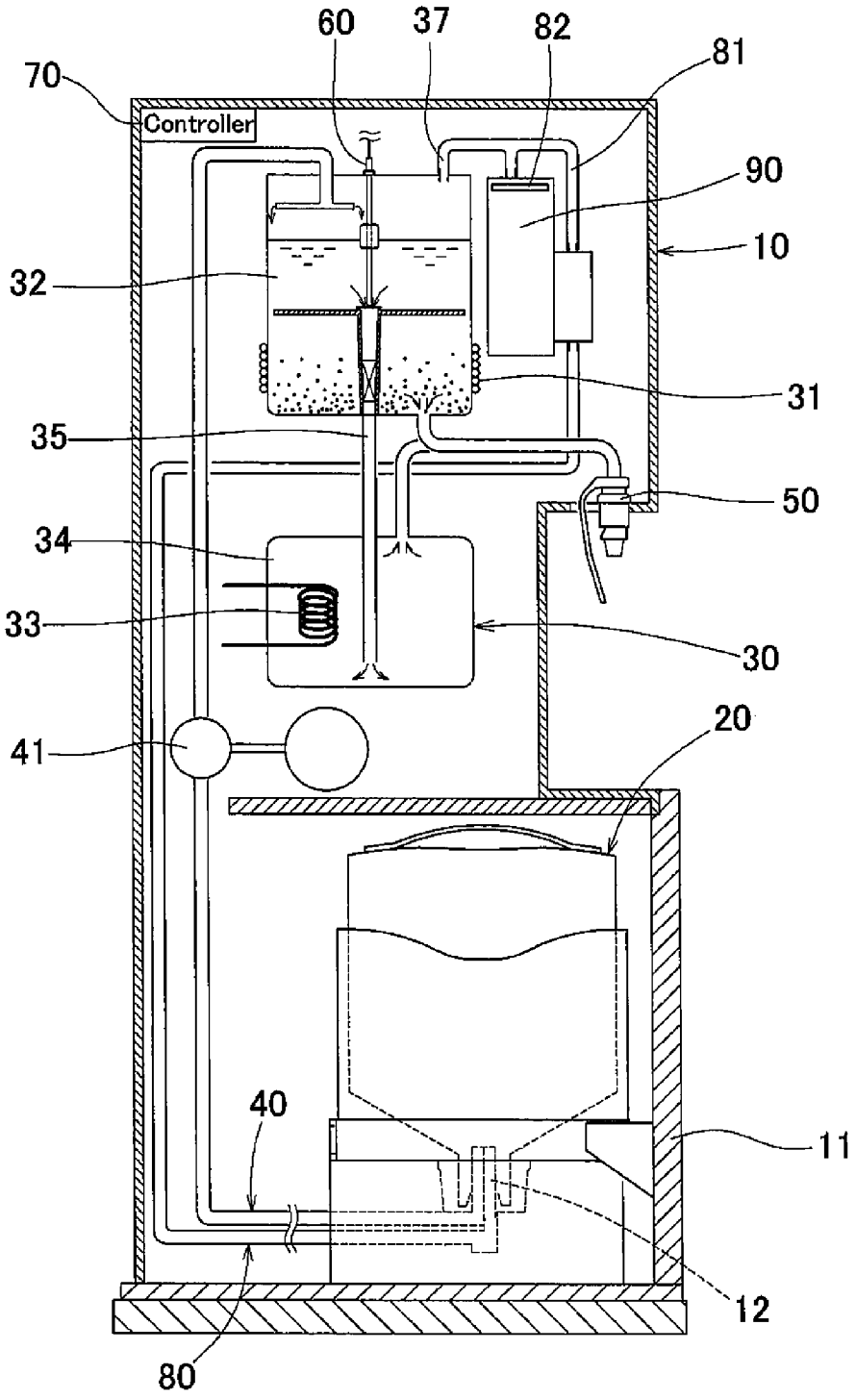
FIG. 2 schematically shows a water dispenser embodying the present invention.

Now referring to the drawings, a water dispenser embodying the present invention is described. As shown in FIG. 2, this water dispenser includes a raw water container 20 placed at a lower portion of a casing 10. Water in the raw water container 20 is lifted through a water supply line 40 into a water storage tank unit 30 disposed in the casing 10 by a pump 41. Water in the water storage tank unit 30 is discharged through a water discharge line 50. The water dispenser further includes a water level sensor 60 which detects the fact that the water level in the water storage tank unit 30 has reached its upper limit or lower limit, and a controller 70 which controls the pump 41.

The raw water container 20 is a soft container having a side wall which is collapsible under the atmospheric pressure as water remaining in the container 20 decreases.

The casing 10 is a vertical machine casing having an opening at the lower portion thereof through which a slide table 11 is slid into and out of the casing 10. The lower portion of the casing 10 refers to a lower portion with respect to the vertical direction. The word "height" as used herein also refers to the height with respect to the vertical direction. The slide table 11 is slidable in a horizontal straight line along guide rails laid on a bottom plate of the casing 10. The slide table 11 has a piercing member 12 which pushes up a plug of the raw water container 20 into the container 20 when the container 20 is placed on the slide table 11 in an upside down position. The interior of the piercing member 12 is divided into two portions serving as first end portions of the water supply line 40 and the air intake line 80, respectively. The piercing member 12 shown is a stationary member, but the piercing member 12 according to the present invention may be a movable one instead.

Figure 3:
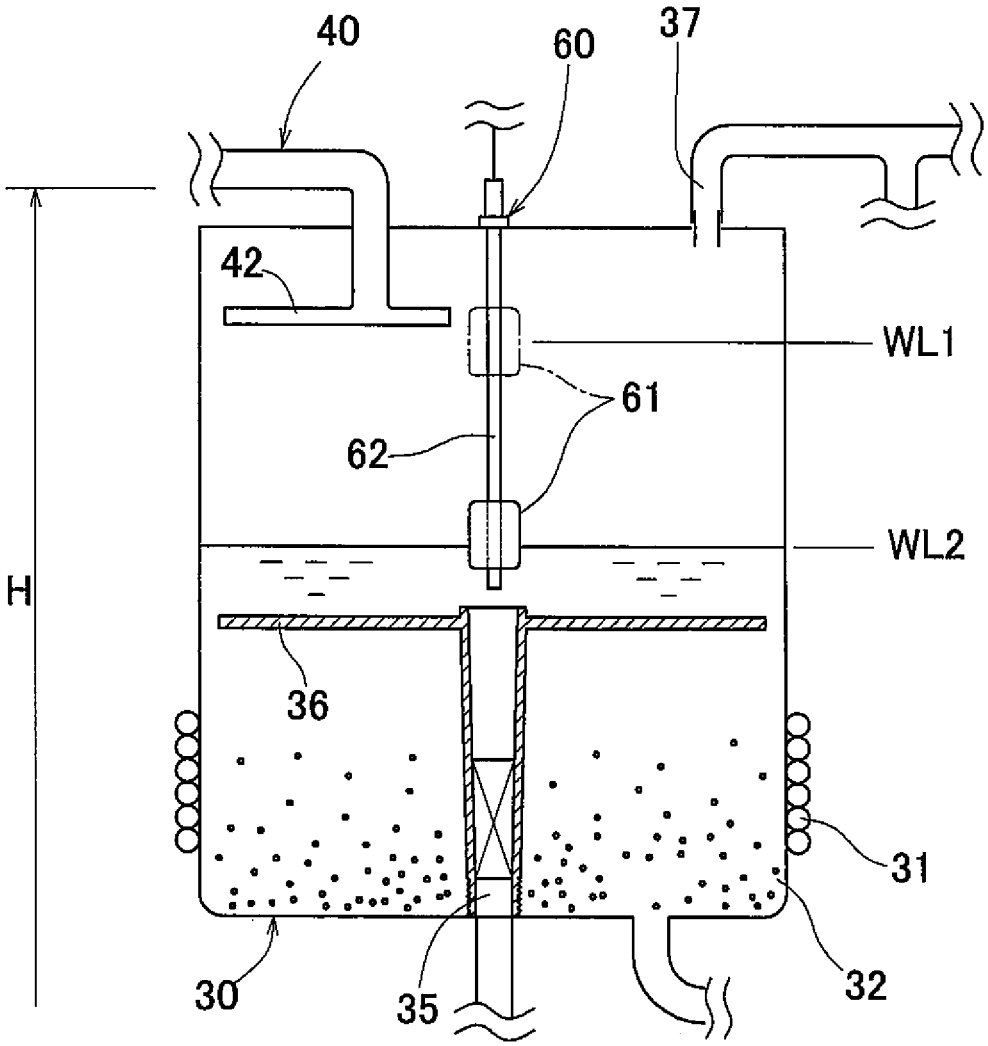
FIG. 3 schematically shows how the water level sensor detects the water level in the embodiment.

As shown in FIGS. 2 and 3, the water storage tank unit 30 is capable of adjusting the temperature of water stored therein, and is configured to store water temporarily. The water storage tank unit 30 includes a cold water tank 32 carrying a heat exchanger 31 for cooling water in the tank 32, and a warm water tank 34 carrying a heater 33 for heating water in the tank 34. The cold water tank 32 and the warm water tank 34 are connected together through a water transfer line 35. The water transfer line 35 extends through a baffle 36 configured to interfere with downward flow of water supplied from the water supply line 40. Water in the raw water container 20 is drawn up through the water supply line 40 and fed into the cold water tank 32. An upper portion of the water in the cold water tank 32 flows through the water transfer line 35 into the warm water tank 34.

The water discharge line 50, which is connected to the water storage tank unit 30, comprises two independent passages, which are a cold water discharge passage connected to the cold water tank 32 and a warm water discharge passage connected to the warm water tank 34. Valves (not shown) are provided at the boundaries between the cold water discharge passage and the water storage tank unit 30 and between the warm water discharge passage and the water storage tank unit 30, respectively. When a user opens one of the valves, water forming a cold water layer (shown by dots in the drawings) in the cold water tank 32 under the baffle 36 flows through the cold water discharge passage and can be discharged into e.g. a cup. When a user opens the other of the valves, an upper portion of the water in the warm water tank 34 flows through the warm water discharge passage and can be discharged into e.g. a cup. One of the cold water tank and the warm water tank may be omitted.

The pump 41 is provided at an intermediate portion of the water supply line 40. The pump 41 may be a plunger pump or a gear pump.

The air intake line 80 includes a vertically extending pipe 81 which is connected at a second end thereof to an air chamber 90. The air intake line 80 has a second end 82 communicating with the atmosphere and serving as an air intake port of the air chamber 90. The interior of the raw water container 20 is in communication with the atmosphere at all times through the air intake line 80. The water dispenser further includes a sterilizer capable of mixing sterilizing air into atmospheric air in the air intake line 80 and the air chamber 90. The sterilizer may be an ozone generator capable of generating ozone from oxygen in atmospheric air taken into the system. The sterilizer is operatively associated with the pump 41.

The water storage tank unit 30 has an air hole 37 which is in communication with the vertically extending pipe 81 of the air intake line 80 and the air chamber 90. When the water level in the water storage tank unit 30 falls, sterilizing air-containing atmospheric air in the vertically extending pipe 81 and the air chamber 90, which are under the atmospheric pressure, is drawn into the water storage tank unit 30 through the air hole 37. When the water level in the water storage tank unit 30 rises, air in the water storage tank unit 30 is discharged into the atmosphere through the air hole 37 and the air chamber 90. Since the overflow height H of the water supply line 40 is lower than the overflow height of the air hole 37, water in the water storage tank unit 30 begins to overflow if the water level reaches the height H.

The water level sensor 60 is a float sensor. The controller 70 is a sequencer for controlling the pump 41 and other elements.

As shown in FIG. 3, the water level sensor 60 is a level switch assembly including a float 61 floating on the water in the water storage tank unit 30. Two lead switches are mounted in a stem 62 and are configured to be switched on and off according to the magnetic field from a permanent magnet attached to the float 61. The water supply line 40 has a second end 42 through which water lifted by the pump 41 is discharged into the tank unit. One of the lead switches is an upper limit detecting switch configured to be switched over by the magnetic field of the permanent magnet attached to the float 61 at water level WL1 which is lower than the overflow height H and also lower than the second end 42 of the water supply line 40, thus generating an upper limit detection signal. The other of the lead switches is a lower limit detecting switch configured to be switched over by the magnetic field of the permanent magnet attached to the float 61 at water level WL2 which is higher than the baffle 36, thereby generating a lower limit detecting signal. The thus detected upper and lower limit detection signals are transmitted to an input unit 71 of the controller 70 shown in FIG. 4.

Figure 4:
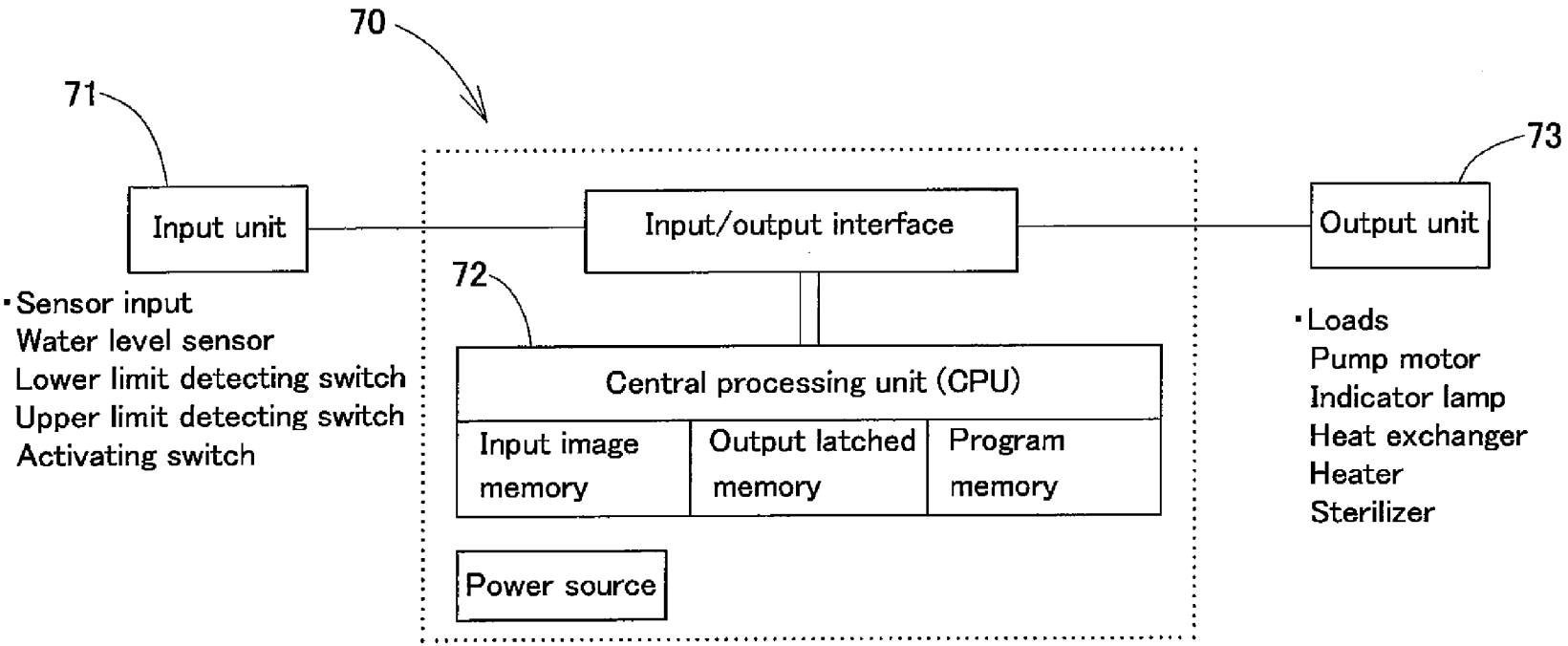
FIG. 4 is a functional block diagram of a controller of FIG. 2.

The input unit 71 of the controller 70, shown in FIGS. 2 and 4, transmits signals from e.g. the water level sensor 60 and operating switches (such signals are hereinafter referred to as "sensor inputs") to a processing unit 72. The processing unit 72 executes programs stored in a program memory such as a timer program and a counter program to write the sensor inputs into an input image memory and write output data generated into an output latched memory. The controller 70 further includes an output unit 73 which converts the output data stored in the output latched memory and the data from the processing unit 72 to signals to be transmitted to external devices such as the pump 41.

The processing unit 72 is programmed to activate the pump 41 upon receiving the sensor input from the water level sensor 60 indicative of detection of the lower limit, deactivate the pump 41 upon receiving the sensor input from the water level sensor 60 indicative of detection of the upper limit, measure the time elapsed after the pump 41 has been activated based on the sensor input from the water level sensor 60 indicative of detection of the lower limit, and deactivate the pump when a predetermined time has elapsed after activation of the pump 41. The predetermined time is determined so as not to exceed the sum of the difference between the first and second time periods, as measured by experiments, necessary for the pump 41 to lift water until the water level increases from WL2 to WL1 (see FIG. 3) and until the water level increases from WL2 to H, respectively, and the second time period. The predetermined time is further determined such that the water level H is never reached, taking into consideration the fact that the pump 41 keeps lifting water for a certain period of time after the predetermined time has elapsed and the pump 41 has been deactivated. This time period is stored in the program memory of the controller 70, shown in FIGS. 2 and 4, beforehand as condition identifying data. If the capacity of the water storage tank unit 30 and the water lifting capacity of the pump 41 are both ordinary values, and if water level WL1 is determined at a height about 30 mm lower than the top dead point, where the float 61 contacts the ceiling of the water storage tank unit 30, the predetermined time may be set at a value about 20% longer than the above first time period.

Figure 1:
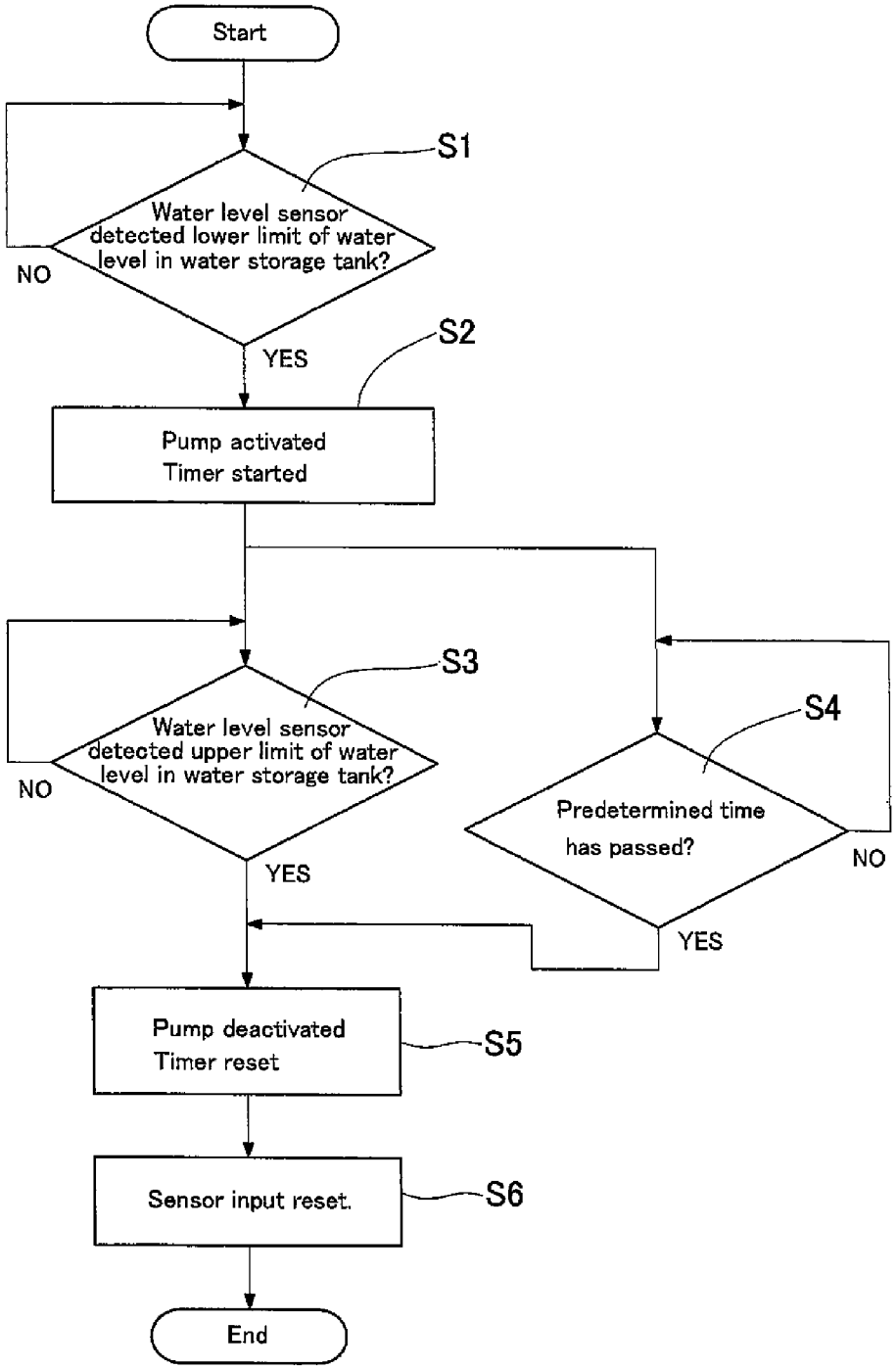
FIG. 1 is a flowchart showing how the pump is controlled according to the present invention.

Referring to the flowchart of FIG. 1 (and occasionally referring also to FIGS. 2 to 4), a detailed description is made of how the controller 70 controls the pump. When the water dispenser is switched on, the processing unit 72 is in a standby position (Start) in which as soon as a signal is transmitted from the water level sensor 60 through the input unit 71, the processing unit 72 is configured to write the transmitted signal into the input image memory (Start). The processing unit 72 then continuously monitors whether or not the data from the water level sensor 60 indicative of detection of the lower limit has been written into the input image memory (Step S1).

When the processing unit 72 confirms that the above data has been written into the memory in Step S1, the processing unit 72 creates a data for activating the pump 41, and transmits the pump activating signal to a control circuit of the pump 41 through the output unit 73, thereby activating the pump 41. When the processing unit 72 confirms that the above data has been written in Step S1, the processing unit 72 starts measuring the time elapsed from activation of the pump 41 (Step S2).

After starting to measure the time elapsed (Step S2), the processing unit 72 starts to monitor whether or not data from the water level sensor 60 indicative of detection of the upper limit has been written into the input image memory (Step S3). Also, after starting to measure the time elapsed (Step S2), the processing unit 72 monitors whether or not the predetermined time is reached (Step S4).

When the processing unit 72 determines that the data indicative of detection of the upper limit has been written in Step S3, the processing unit 72 creates a data for deactivating the pump 41, and transmits the pump deactivating signal through the output unit 73, thereby deactivating the pump 41. Also, when the processing unit 72 determines that the data indicative of detection of the upper limit has been written in Step S3, the processing unit 72 stops measuring the time elapsed and resets the timer (Step S5).

If the processing unit 72 determines that the predetermined time is reached in Step S4, the processing unit 72 creates a data for deactivating the pump 41 and transmits the pump deactivating signal through the output unit 73 (Step S3), thereby deactivating the pump 41. By setting the predetermined time, if the water level exceeds the upper level value WL1, the pump 41 loses its function of lifting water before the water level reaches the overflow level H. In other words, in this water dispenser, even if the water temperature, tank inner pressure, scale adhered to the stem 62, and any other factor cooperate, coincidentally, to temporarily make it difficult for the float 61 to smoothly move along the stem 62, or cause the float 61 to get stuck on the stem 62, thereby making it impossible for the water level sensor 60 to normally detect the upper limit of the water level, it is still possible to prevent overflow of the water storage tank unit 30.

Once the processing unit 72 determines that the fact that the predetermined time is reached has been written (in Step S4), the processing unit 72 stops measuring the time elapsed and resets the timer (Step S5).

After Step S5, the processing unit 72 clears the data indicative of detection of the lower limit and the data indicative of detection of the upper limit stored in the input image memory, and returns to "Start" (Step S6). The controller 70 is thus reset. After Step S6, when water in the water storage tank unit 30 is consumed, and the water level, water temperature and tank inner pressure change, the conditions that have prevented smooth movement of float 61 along the stem 62 will disappear, allowing smooth movement of the float 61 along the stem 62, and thus allowing the water level sensor 60 to detect the lower limit of the water level. Once the lower limit is detected, the controller 70 writes the new sensor input on the detection of the lower limit into the input image memory, and thus repeats the Steps S1 to S5, thereby again activating and then deactivating the pump 41, in a normal manner. If, however, the float 61 should still remain stuck and be unable to move smoothly after water in the tank unit 30 is consumed, the controller 70 is unable to detect the lower limit of the water level, so that the pump 41 will never be activated as long as the water level sensor 60 is unable to detect the lower limit and thus the upper limit, of the water level.

(Initial Movement of the Water Dispenser after Exchanging the Raw Water Container 20 with a New One)

After setting a brand-new raw water container 20 in position in the casing 10, together with the slide table 11, the pump 41 is activated. In particular, when a sensor input indicative of activation of the pump is entered, the controller 70 activates the pump 41. Water in the raw water container 20 is thus drawn up to the water storage tank unit 30 by the pump 41. When water in the raw water container 20 decreases gradually, the side wall of the raw water container 20 is gradually collapsed under the atmospheric pressure, so that the height of the raw water container 20 gradually decreases. While the raw water container 20 is being compressed and the inner space is decreasing, no extra force is necessary for the pump 41 to lift water. While the pump 41 is on, since the sterilizer is activated, sterilizing air increases in the vertically extending pipe 81 and in the air chamber 90. When the sensor input indicative of detection of the upper limit of the water level is entered (Step S1), the controller 70 proceeds to Steps S2 to S6 to deactivate the pump 41, and further deactivates the sterilizer and activates the temperature adjusting devices (heat exchanger 31 and heater 33) of the water storage tank unit 30.

(Resupplying Water into the Water Storage Tank Unit 30 of the Water Dispenser)

After the above initial movement, every time the sensor input from the water level sensor indicative of detection of the lower limit is transmitted to the controller 70 after water has been repeatedly discharged through the discharge line 50, the controller 70 carries out Steps S1 to S6. This prevents overflow of the water storage tank unit 30. When the side wall of the raw water container 20 is collapsed and compressed until the rigidity of the side wall overcomes the atmospheric pressure, the side wall becomes incompressible any further. When water in the raw container 20 further decreases from this state, atmospheric air is spontaneously drawn into the raw water container 20 through the air intake line 80, thereby avoiding negative pressure in the raw water container 20. In this state, even though the volume of the raw water container 20 does not decrease, since atmospheric air is spontaneously drawn into the raw water container 20, the interior and exterior of the raw water container 20 are kept at the atmospheric pressure. Thus, no extra force is necessary for the pump 41 to lift water in this state too. When the water level in the raw water container 20 falls below the opening of the first end portion of the water supply line 40, water remaining in the container 20 cannot be used any more. The water dispenser according to the present invention includes a sensor for detecting this state, namely the state in which water remaining in the container 20 cannot be used any more. When a sensor input indicative of this state is transmitted to the controller 70, the controller 70 aborts Steps S3 and S4, deactivates the pump 41, and notify the user of the necessity to exchange the raw water container 20 with a new one, such as by turning on a lamp. Thereafter, when a sensor input indicative of activation of the pump is entered (in the initial movement after exchanging containers), the controller 70 restarts Steps S3 and S4 to continuously measure the elapsed time in Step S4.

Since the water dispenser according to the present invention is configured such that atmospheric air is spontaneously drawn into the raw water container 20 through the air intake line 80, no pressure difference is supposed to be generated between the interior of the container 20 and the atmospheric pressure, which provides extra resistance to the pump 41. Actually, however, when the raw water container 20 is compressed to the limit, the elastic restoring force of the raw water container 20 generates the above-mentioned pressure difference and thus provides the above-mentioned extra resistance to the pump 41. This resistance tends to become maximum immediately before atmospheric air is spontaneously drawn into the raw water container 20 (which is when the raw water container 20 has been compressed to the limit and its volume becomes minimum). Thus, if the time from the start of the pump 41 until the upper limit is reached is measured based on the water lifting capacity of the pump 41 at this moment, this time tends to be too long. For example, if the water lifting capacity of the pump 41 is relatively small, such a pump may be able to lift water only by 25 units per second immediately before air is spontaneously sucked into the container, while this pump can suck water by 100 units per second from a newly exchanged container 20. However, since the pump 41 of the water dispenser according to the present invention has a sufficiently large water lifting capacity compared to the above-mentioned resistance, even if the above predetermined time is determined based on the pump lifting capacity immediately before air is spontaneously sucked into the container 20, overflow will never occur. However, if the water lifting capacity of the pump 41 is not sufficiently large, and thus it is not appropriate to use the single common predetermined time value every time water is sucked up, preferably, predetermined time values are measured for the respective water lifting operations, the thus measured predetermined time values are stored in the controller 70, the number of water lifting operations is counted every time water is sucked up by the pump, and the corresponding predetermined time value is used every time water is sucked up based on the reading on the counter, in Step S4.

The present invention is not limited to the above-described embodiment, but encompasses every modification that is within the scope of the below-identified claims. For example, the controller 70 may have the function of detecting any electrical trouble of the objects to be controlled by the controller, including the pump 41 and the water level sensor 60, such as breakage of wires.

DESCRIPTION OF THE NUMERALS

10. Casing
20. Raw water container
30. Water storage tank unit
40. Water supply line
41. Pump
50. Water discharge line
60. Water level sensor
61. Float
62. Stem
70. Controller
71. Input unit
72. Processing unit
73. Output unit
80. Air intake line

What is claimed is:

1. A water dispenser comprising;

a water supply line through which water in an exchangeable raw water container is drawn up to a water storage tank provided in a casing by means of a pump, the water storage tank including a baffle configured to interfere with downward flow of water supplied from the water supply line;

a water discharge line through which water under the baffle in the water storage tank is discharged;

a water level sensor configured to detect (i) an upper limit of a water level in the water storage tank and (ii) a lower limit of the water level in the water storage tank, the lower limit of the water level in the water storage tank being above the baffle included in the water storage tank; and a controller for controlling the pump, wherein the controller is configured to (i) activate the pump upon receiving a sensor input indicative of detection of the lower limit and (ii) deactivate the pump upon receiving a sensor input indicative of detection of the upper limit, wherein the controller is further configured to (i) measure a time elapsed since the pump was activated upon receiving the sensor input indicative of the detection of the lower limit and (ii) deactivate the pump when the time elapsed reaches a predetermined time since receiving the sensor input indicative of the detection of the lower limit at which the water level exceeds the upper limit and at which water in the water storage tank has not yet overflown the water storage tank.

2. The water dispenser of claim 1, wherein the water level sensor comprises a float sensor, and wherein the controller is configured to reset inputs from the water level sensor when the pump is deactivated.

* * * * *